United States Patent [19]

Justus

[11] 4,161,205

[45] Jul. 17, 1979

[54] METHOD AND APPARATUS FOR PLYBONDING CONTROL

[75] Inventor: Edgar J. Justus, Beloit, Wis.

[73] Assignee: Beloit Corporation, Beloit, Wis.

[21] Appl. No.: 804,516

[22] Filed: Jun. 8, 1977

[51] Int. Cl.[2] ..... D21F 1/06; D21F 1/08; D21F 11/08

[52] U.S. Cl. ..... 162/133; 73/432 L; 162/198; 162/252; 162/253; 162/256; 162/258; 162/259; 162/262; 162/263; 162/304; 162/317; 356/72; 356/436

[58] Field of Search ..... 162/132, 133, 217, 304, 162/305, 317, DIG. 11, 198, 263, 347, 123, 300, 254, 258, 259, 262, 252, 253, 256; 73/432 L; 356/201, 72; 331/DIG. 1

[56] References Cited

U.S. PATENT DOCUMENTS

| | | | |
|---|---|---|---|
| 3,485,715 | 12/1969 | Kobayashi | 162/304 |
| 3,620,914 | 11/1971 | Rocheleau | 162/259 |
| 3,726,758 | 4/1973 | Parker et al. | 162/317 |
| 3,734,821 | 5/1973 | Curtis | 162/317 |
| 3,907,635 | 9/1975 | Bringman | 162/317 |
| 3,985,612 | 10/1976 | Watanabe | 162/304 |
| 4,004,968 | 1/1977 | Braun et al. | 162/317 |

FOREIGN PATENT DOCUMENTS

| | | | |
|---|---|---|---|
| 2152552 | 3/1972 | Fed. Rep. of Germany | 162/DIG. 11 |

*Primary Examiner*—S. Leon Bashore
*Assistant Examiner*—Steve Alvo
*Attorney, Agent, or Firm*—Hill, Van Santen, Steadman, Chiara & Simpson

[57] ABSTRACT

A method and apparatus for forming a multi-ply web of paper wherein a first layer is carried on the underside of a traveling felt to a bonding station located over the top of a forming cylinder on which a second layer is formed with a water bead in the nip between the layers and a laser or other device for generating a beam of energy at one end of the nip directing the energy along the water bead parallel to the nip and a receiver at the other end to detect the laser beam with means operated by the receiver for controlling the size of the water bead.

5 Claims, 2 Drawing Figures

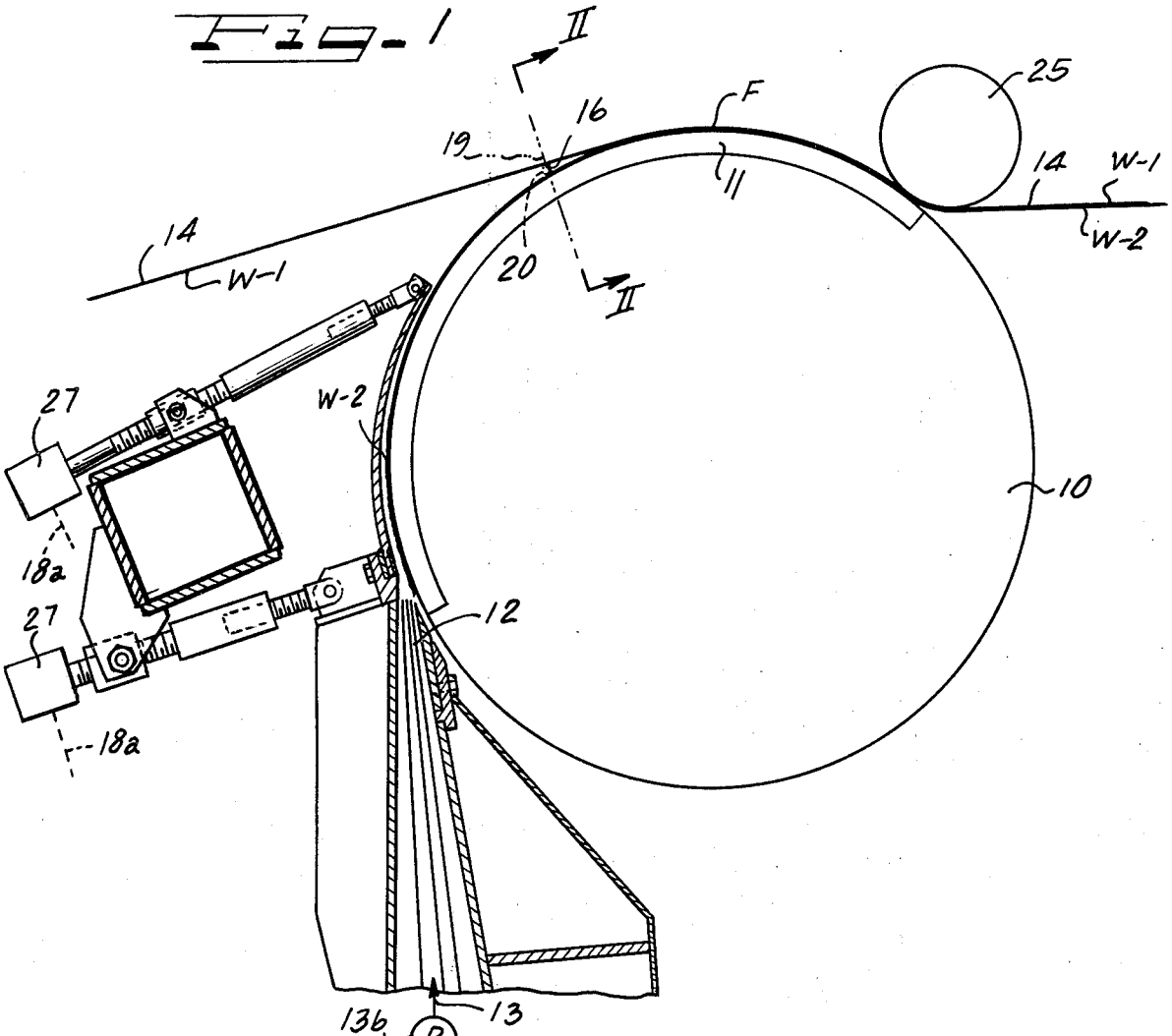
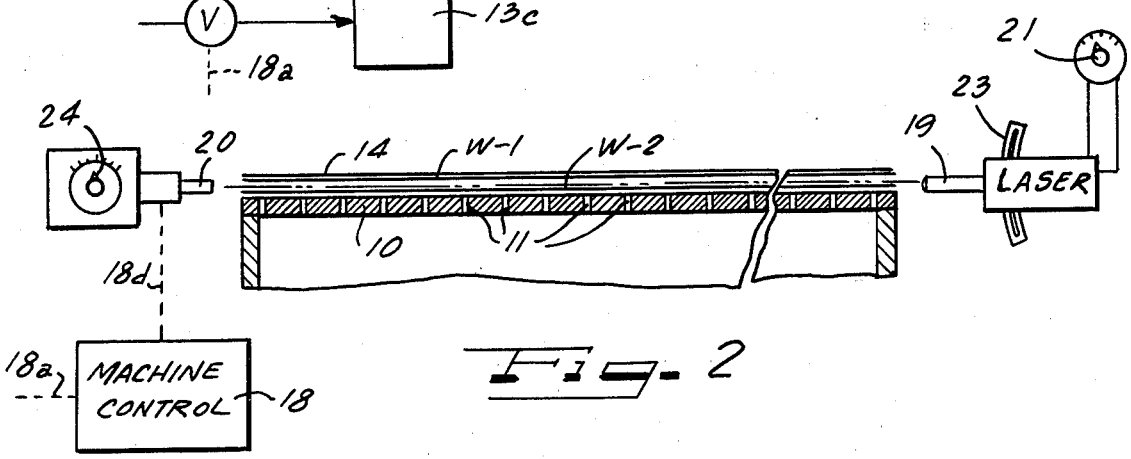
Fig-2

METHOD AND APPARATUS FOR PLYBONDING CONTROL

BACKGROUND OF THE INVENTION

The present invention relates to improvements in paper forming machines, and more particularly to a machine for forming and bonding together plural plies of fibrous web, particularly for controlling the size of the water bead between the layers at the location where the plies come together.

In the formation of a multilayered paper web, individual layers are separately formed and brought together while wet to be bonded. Bonding is accomplished by an interlocking of the fibers on the confronting faces of the two layers, and optimum bonding forms the two layers to act as one so that a monolithic sheet results. The two layers can each contribute their own physical properties to the resultant sheet, and it is essential that a positive and uniform bond be completed over the entire surface of the layers.

It has been discovered that an improved bond will be augmented by the formation and maintenance of the bead of water in the nip between the layers as they are brought together. This bead probably acts as a conveying medium for small fiber ends to pass from one layer into the other layer and to there interlock. Where the lower layer is formed on the surface of a cylinder machine and the upper layer positioned over the first layer, suction is applied to the juxtaposed layer through the porous cylinder and additional water will pass downwardly from the upper layer to the lower layer to aid in the interlocking procedure. With the provision of a water bead between the layers, this moisture will pass downwardly into the lower layer forming a uniform interlock. It is essential to optimum plybonding that the bead of water be maintained at an optimum size. If the bead is of an insufficient size, it will not help the bonding between layers, or will help insufficiently to create the bond desired. If the bead is too large, it can act to adversely affect the orientation of the fibers and can keep the fibers between the layers apart so that actually a poorer bond results. When a bead of an optimum size is attained, it must be maintained for a given speed so that uniform bonding results, and the control of this bead size is important to the character and quality of the finished sheet of paper. The bead must be maintained uniform across the width of the paper, and control of various factors will increase or decrease the size of the bead. For example, the bead size will change with regulation of the stock density, the machine speed, suction in the forming cylinder, type of stock fiber, slice opening, fan pump pressure and other factors known to paper makers. However, this control must be accurately regulated, and the control operates best if it is not merely a function of the operating parameters of the machine, but operates to maintain a bead of the proper physical size. In other words, the change in the factors relating to the layers or to the speed of the machine are not as significant as the actual size of the water bead once an optimum size has been attained.

It is accordingly an object of the present invention to sense the size of a water bead between the nip of multiple layers in a paper making machine for making multilayered paper and to control and maintain the bead size to maintain an optimum moisture level for maximum bonding between plies.

A still further object of the invention is to provide a means for sensing and controlling the size of a water bead in bonding two layers of fibrous web wherein the size of the bead can be regulated to accommodate various changes in operating parameters and to maintain a bead of optimum desired size.

A further object of the invention is to provide a simplified construction which may be utilized on new paper making machines and can be installed and implemented as well on existing machines for detecting and controlling the size of the water bead for optimum plybonding.

Other objects, advantages and features, as well as equivalent structures and methods which are intended to be covered herein, will become more apparent with the teaching of the principles of the invention in connection with the disclosure of the preferred embodiments thereof in the specification, claims and drawings, in which:

DRAWINGS

FIG. 1 is a side elevational view in schematic form illustrating a portion of a multi-ply paper web making machine constructed and operating in accordance with the principles of the present invention; and FIG. 2 is a fragmentary sectional view taken substantially along line II—II of FIG. 1.

DESCRIPTION

As illustrated in the drawings, a first layer of fibrous web W-1, such as paper, has been formed and is carried on the under surface of a traveling felt 14 to a forming station shown generally at F wrapped over the top portion of a porous cylinder 10. The first web will still be relatively wet and fresh so that plybonding can readily occur with a freshly made second lower layer W-2.

The second layer is formed on the outer surface of a porous forming cylinder 10 with the stock supplied through a slice 12 from a stock supply 13 on the uprunning side of the cylinder. The stock is dewatered into the cylinder with the water removed being received by a suction gland 11 which extends up over the bonding portion of the cylinder. That is, on the uprunning side the vacuum dewaters the lower layer W-2 and subsequently continues dewatering as the two layers are placed in juxtaposed relationship and draws the water downwardly aiding in the interlocking between fibers between the layers to form an adequate and uniform bond.

A pressure bonding roll 25 presses the layers together and causes an additional flow of water between the layers to aid in interlocking the fibers. A water bead 16 will automatically form and is located at the nip between the two layers coming together. The size of the water bead 16 is critical to optimum bonding. The size of the water bead needed for optimum bonding will be determined depending upon the paper to be made. Control of bead size is obtained by a machine control 18 which controls one or more machine factors including the speed of operation of the machine, the type of stock used, the vacuum in the suction roll gland, the consistency of the stock and the slice opening.

The control 18 is connected to motors, valves and other machine operations to control the foregoing factors to vary the size of the bead.

In accordance with the principles of the present invention, the amount of water supplied between the sheets is controlled by sensing the size of the bead and maintaining it at a predetermined size. For this purpose a mechanism for generating a beam of energy is positioned at one end of the nip and illustrated in the form of a laser 19. Instead of a laser, a mechanism for generating a beam of columinated light may be provided, and at the other side of the nip is a sensor 20 which senses the beam energy passing along the nip. As the water bead increases, the amount of energy passing from one side of the web to the other will be decreased, and as the bead decreases, the amount of energy passing will be increased so that the sensor 20 will provide an output signal which is a function of bead size.

The laser beam generator is accurately positioned and may be provided with adjustment mechanism 23 so that the beam will be directed precisely parallel to the nip and may be desirable to project the laser beam just at the trailing end of the bead so that it will be interrupted as the bead grows beyond a predetermined size and will be uninterrupted as the bead diminishes below a predetermined size. By operation of the sensor 20 at the other side, the bead can be maintained at the precise size.

The intensity of the pulsed laser beam can be controlled by a laser control 21 which controls the operation of the beam generator 19. The sensor 20 may have a regulating control dial 24 which determines the level of operation, and a connection **18*d* is provided between the sensor and the controls such as 18 and 27 which control mechanism affecting the size of the water bead 18. As the energy level from the laser beam is diminished, indicating that the water bead is growing beyond a predetermined size, the control 18 will be operated to reduce the size of the bead. Similarly, as the energy level received by the sensor 20 is decreased indicating that the water bead is growing below the predetermined optimum size, the control 18 is operated to increase the size of the bead. For example, the control 18 may be connected to operators 27 through control connections 18*a* to move the slice lip 26 open or closed which has the effect of increasing or decreasing the bead size. The control may also be connected to a valve 13*a* leading to a stuff box 13*c* which changes the consistency or water content of the stock and may also be connected to a fan pump 13*b*** to change the stock delivery pressure.

This operation continues automatically and substantially instantaneously so that during operation, the bead will remain at a uniform constant predetermined size determined by the energy level setting 24 of the sensor and by the adjusted position for the laser 19. The adjustment mechanism 23 is shown schematically, but it will be understood that the position of the laser can be adjusted vertically and horizontally relative to the nip so that it can be positioned at the optimum position and the laser will also be directionally adjustable so that the beam is directed exactly parallel to the nip.

Thus, it will be seen that I have provided an improved method and mechanism which meets the objectives and advantages above set forth and which is capable of control of plybonding in multiple web paper making machines to accommodate a wide variation of operation conditions.

I claim as my invention:

1. A mechanism for making a multilayered fibrous web comprising in combination:

a felt for carrying a first web layer on its lower surface to a bonding station;

a perforate web forming cylinder forming a second web layer on the surface with said felt wrapping a portion of the upper surface of the cylinder for laying the first layer on the second layer at said bonding station;

means delivering a slurry of stock to the cylinder on the uprunning side for forming a web thereon;

means forming a vacuum within the cylinder for dewatering the web layer formed on the cylinder and aiding in bonding the web layers;

means for forming a water bead to a nip between layers at said bonding station where the first layer joins the second;

a power beam generator projecting a beam into the nip to detect said water bead;

a beam receiver sensing the energy of the beam passing through the nip and emitting an output signal as a function of the size of the water bead depending on the receiver output signal; and control means connected to the mechanism to vary an operating factor of the mechanism for changing the size of said bead, and said control means connected to said receiver and receiving the output signal thereof and connected to the mechanism for changing the size of said bead to maintain the bead at a predetermined size for obtaining optimum bonding between said layers.

2. A mechanism for making a multilayered fibrous web constructed in accordance with claim 1 wherein:

said beam generator is located at one end of the nip and the beam receiver at the other end of said nip.

3. A mechanism for making a multilayered fibrous web constructed in accordance with claim 1 wherein:

said control means is connected to the means delivering the slurry of stock to control the size of the water bead in the nip.

4. A mechanism for making a multilayerd fibrous web constructed in accordance with claim 1 and including:

a press roll pressing downwardly on the first layer against the second layer at the end of said bonding station.

5. The method of forming a multilayered fibrous web comprising the steps of laying a first web layer on the lower surface of a felt and carrying it to a bonding station, forming a second web layer on the surface of a perforate web forming cylinder with said felt wrapping a portion of the upper surface of the cylinder for laying the first layer on the second layer at said bonding station; delivering a slurry of stock to the cylinder on the uprunning side for forming a web thereon, forming a vacuum within the cylinder for dewatering the web layer formed on the cylinder and aiding and bonding the web layers, forming a water bead at a nip between layers at said bonding station where the first layer joins the second layer, projecting a beam from a power beam generator into the nip to detect said water bead, sensing the energy of the beam passing through the nip with a beam receiver which emits an output signal which varies as a function of the size of the water bead and controlling the operating conditions of the bonding station depending upon the receiver output signal to maintain the bead at a predetermined size for optimum bonding between said layers.

* * * * *